US011112710B2

(12) United States Patent
Nakayama et al.

(10) Patent No.: US 11,112,710 B2
(45) Date of Patent: Sep. 7, 2021

(54) TONER AND METHOD FOR PRODUCING TONER

(71) Applicant: CANON KABUSHIKI KAISHA, Tokyo (JP)

(72) Inventors: Kenichi Nakayama, Numazu (JP); Takeshi Kaburagi, Suntou-gun (JP); Shintaro Kawaguchi, Yokohama (JP); Shota Amano, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/814,100

(22) Filed: Mar. 10, 2020

(65) Prior Publication Data

US 2020/0292953 A1 Sep. 17, 2020

(30) Foreign Application Priority Data

Mar. 14, 2019 (JP) ..... JP2019-047177
Feb. 18, 2020 (JP) ..... JP2020-025110

(51) Int. Cl.
*G03G 9/08* (2006.01)
*G03G 9/087* (2006.01)

(52) U.S. Cl.
CPC ..... *G03G 9/08755* (2013.01); *G03G 9/0819* (2013.01); *G03G 9/0823* (2013.01); *G03G 9/0827* (2013.01); *G03G 9/08782* (2013.01)

(58) Field of Classification Search
CPC .. G03G 9/0819; G03G 9/0823; G03G 9/0827; G03G 9/08755; G03G 9/09708
USPC ..... 430/108.6, 108.1
See application file for complete search history.

(56) References Cited

U.S. PATENT DOCUMENTS 6,316,157 B1 11/2001 Yoshikawa et al.
6,346,356 B1 2/2002 Ohno et al.
6,638,674 B2 10/2003 Komoto et al.
6,653,035 B2 11/2003 Komoto et al.
7,029,813 B2 4/2006 Mikuriya et al.
7,043,175 B2 5/2006 Komoto et al.
7,112,393 B2 9/2006 Komoto et al.
7,153,625 B2 12/2006 Kaburagi et al.
7,160,663 B2 1/2007 Komoto et al.
7,241,546 B2 7/2007 Moriki et al.
7,371,494 B2 5/2008 Chiba et al.
7,387,860 B2 6/2008 Moriki et al.
7,560,212 B2 7/2009 Chiba et al.
8,841,056 B2 9/2014 Yoshizaki et al.
9,423,714 B2 8/2016 Kenmoku et al.
9,785,068 B2 10/2017 Umeda et al.
9,829,816 B2 11/2017 Tanaka et al.
10,747,136 B2 * 8/2020 Kenmoku ..... G03G 9/0806
2006/0166120 A1 7/2006 Moriki et al.
2006/0222992 A1 10/2006 Kamoto
2007/0020550 A1 1/2007 Kamoto
2015/0248072 A1 9/2015 Katsuta et al.
2017/0123333 A1 5/2017 Kuroki et al.
2019/0235402 A1 8/2019 Inoue et al.
2019/0332027 A1 10/2019 Kenmoku et al.

FOREIGN PATENT DOCUMENTS

JP 2008-107769 5/2008
JP 2013-003367 1/2013

OTHER PUBLICATIONS

U.S. Appl. No. 16/808,782, Shota Amano, filed Mar. 4, 2020.
"Chemical Dictionary" (1st Edition, Tokyo Kagaku Dojin, 1989) (Partial English translation of Calcium in p. 475).
"Chemical Handbook, Basic Edition II" (revised 4th edition, edited by the Chemical Society of Japan, Maruzen, 1993) (Partial English Translation of pp. 490-491, Table 13.4 Resistivity of simple substance and temperature coefficient thereof).

* cited by examiner

*Primary Examiner* — Mark A Chapman
(74) *Attorney, Agent, or Firm* — Venable LLP

(57) ABSTRACT

A toner comprising: a toner particle that includes a binder resin, and an external additive, wherein the toner particle includes a polyester resin on the surface; the toner particle includes a polyvalent metal element; where an electrical resistivity of the polyvalent metal element at 20° C. is denoted by A Ω·m, and an amount of the polyvalent metal element in the toner particle is denoted by B μmol/g, a following relationship is satisfied:

$$0.025\times10^{8}\leq(1/A)\times B\leq4.500\times10^{8};$$

the external additive includes silica particles; and the silica particles includes spherical silica particles having a number average particle diameter of from 20 nm to 40 nm.

9 Claims, No Drawings

TONER AND METHOD FOR PRODUCING TONER

BACKGROUND OF THE INVENTION

Field of the Invention

The present invention relates to a toner for electrostatic image development and a method for producing the same.

Description of the Related Art

A method of visualizing image information via an electrostatic latent image, such as an electrophotographic method, is currently used in various fields, and improvement of performance including improvement of image quality and increase in speed is required.

In particular, there is a growing demand for small-sized copiers and printers with low power consumption. Therefore, there is a need for a toner which is excellent in low-temperature fixability, has good storability, and can maintain excellent image quality for a long period of time.

In response to this demand, a large number of toners produced by an emulsion aggregation method have been proposed because this method enables a wide range of material selectivity, easy control of the shape of toner particle, and the inclusion of a large amount of a release agent.

In the emulsion aggregation method, a resin particle dispersion obtained by emulsion polymerization, forced emulsification, phase inversion emulsification or the like, and a colorant dispersion in which a colorant is dispersed in a solvent etc. are prepared. Thereafter, these are mixed to form an aggregated particle corresponding to a toner particle diameter, and a toner is then produced by coalescence and fusion induced by heating.

Japanese Patent Application Publication 2008-107769 discloses a toner produced by the emulsion aggregation method in which aluminum is included in a toner particle and the amount of aluminum is 0.02 to 0.30 in terms of net intensity determined by X-ray fluorescence.

It is indicated that according to this technique, a part of the aluminum and the polar part, such as carboxylic acid, in a binder resin molecule forms a crosslinked structure, thereby making it possible to achieve both a satisfactory charge quantity and a low-temperature fixability.

Japanese Patent Application Publication No. 2013-3367 discloses an image forming method using a toner in which monodisperse spherical particles having a number average primary particle diameter of from 50 nm to 150 nm are externally added to a toner particle in which a styrene-acrylic copolymer core surface is coated with a styrene-acrylic modified polyester shell as a toner produced by an emulsion aggregation method.

According to this technique, the toner particle surface is smoothed, the adhesive force of the external additive having a relatively large particle diameter to the toner particle is increased, both the spacer effect and the suppression of separation can be achieved, and printed matter having high image quality can be stably fabricated.

SUMMARY OF THE INVENTION

Generally, in a toner manufactured by an emulsion aggregation method such as mentioned hereinabove, polyvalent metal ions derived from a flocculant are present in a binder resin. Such polyvalent metal ions are present near the surface of the toner particle and inside the toner particle, but in a high-temperature and high-humidity environment, the charge amount of the toner tends to decrease due to the effect of moisture absorption characteristics of the polyvalent metal ions.

To resolve this problem, in the conventional toners including that disclosed in the abovementioned patent literature, a method has been used in which the surface of a toner particle is coated with fine particles of an external additive such as silica or titanium oxide to suppress the influence of a decrease in the charge amount. Further, as disclosed in Japanese Patent Application Publication 2013-3367, a method has been used in which silica particles having a relatively large particle diameter are added in combination as spacer particles, thereby suppressing the embedding of the external additive fine particles and maintaining the coverage effect of external additive fine particles.

However, it was understood that where the conventional toner is used in a more severe development process corresponding to a longer life and a higher speed, the reduction of the charge amount in a high-temperature and high-humidity environment cannot be suppressed, and a problem of fogging and image density decrease arises.

In addition, with the conventional toner, where a large number of prints are made in a low-temperature and low-humidity environment to the contrary, the flowability of the toner tends to decrease and the charge-up due to the accumulation of the charge amount is likely to occur. This was found to be the reason why image quality degradation such as poor regulation and development ghosts becomes apparent. As indicated hereinabove, the conventional toner still has a problem in the stability of environmental charging characteristics.

The present invention provides a toner that excels in the stability of density and suppression of fogging in a high-temperature and high-humidity environment, and also suppresses the occurrence of poor regulation and development ghost in a low-temperature and low-humidity environment and excels in environmental charging characteristics even in an image forming apparatus adapted to high-speed and long-life usage.

The present invention relates to a toner comprising:

a toner particle that includes a binder resin and a polyvalent metal element, and an external additive, wherein a surface of the toner particle comprises a polyester resin;

where an electrical resistivity of the polyvalent metal element at 20° C. is denoted by A Ω·m, and an amount of the polyvalent metal element in the toner particle is denoted by B μmol/g, a following relationship is satisfied:

$$0.025\times10^{8}\leq(1/A)\times B\leq4.500\times10^{8};$$

the external additive includes a silica particle; and the silica particle includes a spherical silica particle having a number average particle diameter of from 20 nm to 40 nm.

According to the present invention, it is possible to provide a toner that excels in the stability of density and suppression of fogging in a high-temperature and high-humidity environment, and also suppresses the occurrence of poor regulation and development ghost in a low-temperature and low-humidity environment and excels in environmental charging characteristics even in an image forming apparatus adapted to high-speed and long-life usage.

Further features of the present invention will become apparent from the following description of exemplary embodiments.

DESCRIPTION OF THE EMBODIMENTS

In the present invention, the expression "from XX to YY" or "XX to YY" representing the numerical range means a numerical range including a lower limit and an upper limit which are endpoints unless otherwise specified.

Hereinafter, the present invention will be described in detail.

The present inventors have intensively studied the possibility of using a toner including a toner particle in which a multivalent metal element is present in a binder resin in an image forming apparatus adapted to high-speed and long-life usage, and still (1) achieving good charge rising performance even after making a large number of prints in a high-temperature and high-humidity environment; and (2) suppressing a charge-up effect and maintaining endurance even after making a large number of prints in a low-temperature and low-humidity environment.

As a result, it was found that the aforementioned aim can be achieved in the case where:

(1) a surface of the toner particle comprises a polyester resin;

(2) the toner particle includes a polyvalent metal element, and where the electrical resistivity of the polyvalent metal element at 20° C. is denoted by A Ω·m, and the amount of the polyvalent metal element in the toner particle is denoted by B the following relationship is satisfied.

$$0.025\times10^{8}\leq(1/A)\times B\leq4.500\times10^{8}.$$

(3) The toner particle includes a spherical silica particle as an external additive, and the number average particle diameter of the spherical silica particle is from 20 nm to 40 nm.

The present inventors consider the following as the reason why the effects of the present invention are exhibited.

As described above, the toner manufactured by the emulsion aggregation method includes a polyvalent metal element derived from a flocculant. Since polyvalent metal ions have a strong tendency to absorb moisture, in a high-temperature and high-humidity environment, triboelectric charging of toner particle is hindered by moisture adsorption, and problems due to insufficient charge amount are likely to occur.

In particular, polyvalent metal ions present near the toner particle surface tend to leak the charge generated by friction with a charge-providing member such as a carrier or a developing roller, and often become a main cause of charge inhibition.

The silica particle used in the present invention is spherical in shape and have a number average particle size of from 20 nm to 40 nm. It can be observed that the silica particles having these characteristics slightly roll on the toner particle surface during contact with a charge-providing member or the like.

Such rolling increases the number of cases in which silica particles are present when the charging member comes into contact with a local charge leakage point where polyvalent metal ions are present on the toner particle surface.

According to the study conducted by the present inventors, in such a case, the charge held by the silica particles first leaks due to contact with the polyvalent metal ions. However, immediately after the leakage, the silica particles roll and leave the leakage point, and at the same time, contact with the charging member is applied to cause triboelectric charging, and local leakage of electric charge can be instantaneously compensated. It is presumed that this action exerts an effect of minimizing the loss of charge occurring on the toner particle surface and spreading from polyvalent metal ions.

The spherical silica particle can be uniformly dispersed on the toner particle surface. It is considered that the above effects can be even more stably exhibited where the entire surface of the toner particle is evenly covered with the spherical silica particles.

In the present invention, when the circularity of the silica particle is 0.80 or more, it is determined that the particles are spherical. The circularity of the silica particle is preferably 0.85 or more, more preferably 0.90 or more. The upper limit is not particularly limited, but the circularity is preferably 1.00 or less, more preferably 0.98 or less.

Where the number average particle diameter of the spherical silica particle is 20 nm or more, the spherical silica particles can roll without being buried in the toner particle surface at the time of contact with a charging member or the like, the possibility of the silica particle being present at a leakage point increases, and excellent charge stability under a high-temperature and high-humidity environment is achieved.

Where the number average particle diameter is 40 nm or less, the charge generated by contact with the charging member can be instantaneously compensated when the spherical silica particle leaves the leakage point.

Meanwhile, the toner of the present invention has an effect of suppressing charge-up by alleviating the accumulation of the charge amount in a low-temperature and low-humidity environment.

Regarding the mechanism by which the accumulation of the charge amount can be alleviated, the present inventors believe that the charge generated by friction on the toner particle surface is leaked to the polyvalent metal ion derived from the flocculant present inside the toner.

The above effects are exhibited because the toner particle surface is a polyester resin, the silica particle is spherical and the number average particle diameter of the silica particle is from 20 nm to 40 nm.

It is considered that because the silica particles used in the present invention are spherical in shape and roll when contacting a member such as a charging member, an opportunity is easily obtained to approach the leakage points of polyvalent metal ions present inside the toner particle.

In order to quickly release the accumulated charge of the silica particles into the toner particle, the charged point (charged site) of the silica particle needs to approach a leakage point in the toner particle. It is conceivable that a size of from 20 nm to 40 nm will be the most suitable size for obtaining an opportunity to approach the leakage point.

Further, it is essential that the toner particle comprises a polyester resin on the surface. As a result, the triboelectric charging with the silica particles can be prevented from overcharging, and the charge generated on the toner particle surface can be caused to propagate rapidly to leakage points inside the toner particle.

The silica particle and the polyester resin have a relationship such that facilitates charge transfer. In the polyester resin, a polar group is less likely to segregate due to the structure thereof, and charge propagation units such as ester groups are uniformly present inside the toner particle. This is apparently why the polyester resin exerts the above effect.

Since the number average particle diameter of the spherical silica particle is 20 nm or more, the spherical silica particles can roll without being buried in the toner particle surface when contacting with a member or the like. When the spherical silica particles approach the polyvalent metal ions present inside the toner particle, leakage of accumulated charges via the polyester resin becomes possible, and charge-up can be suppressed.

Where the number average particle size is 40 nm or less, an opportunity is obtained for the charged point (charged site) of the silica particle to approach a leakage point inside the toner particle, and the accumulated charge can be leaked quickly.

The number average particle diameter of the spherical silica particle is preferably from 22 nm to 38 nm.

The toner particle includes a polyvalent metal element, and where the electrical resistivity of the polyvalent metal element at 20° C. is denoted by A Ω·m, and the amount of the polyvalent metal element in the toner particle is denoted by B μmol/g, the following relationship needs to be satisfied.

$$0.025\times10^{8}\leq(1/A)\times B\leq4.500\times10^{8}.$$

As a result of setting the value of (1/A)×B to $0.025\times10^{8}$ or more, appropriate charge leakage sites due to polyvalent metal elements can be made present on the surface and inside of the toner particle. Therefore, the accumulated charge on the toner particle surface can be diffused into the toner particle in a low-temperature and low-humidity environment, and charge-up can be suppressed.

By setting the value of (1/A)×B to $4.500\times10^{8}$ or less, in the toner composition of the present invention, charge leakage under a high-temperature and high-humidity environment can be compensated by the charge provided by spherical silica, excellent ability to maintain charge rising performance can be attained, and the generation of fogging and decrease in density can be suppressed.

It is preferable that (1/A)×B satisfy the following relationship:

$$0.030\times10^{8}\leq(1/A)\times B\leq4.400\times10^{8}.$$

A value described in the "Chemical Dictionary" (Tokyo Kagaku Dojin, 1989) and the "Chemical Handbook: Basic Edition II, 4th Edition" (edited by The Chemical Society of Japan, published by Maruzen, 1993, page 490) can be used as the electrical resistivity of the polyvalent metal element at 20° C.

When there are a plurality of polyvalent metal elements, (1/A)×B is calculated for each polyvalent metal element, and the total value is used.

The electrical resistivity at 20° C. of the polyvalent metal element is preferably from $2.5\times10^{-8}$ Ω·m to $10.0\times10^{-8}$ Ω·m. When the electrical resistivity is in the above range, a special effect is demonstrated on stability of charge leakage and suppression of charge-up.

The polyvalent metal element can be, for example, at least one selected from the group consisting of aluminum $2.7\times10^{-8}$ Ω·m, calcium $3.5\times10^{-8}$ Ω·m, magnesium $4.5\times10^{-8}$ Ω·m, and iron $9.7\times10^{-8}$ Ω·m.

At least one metal selected from the group consisting of aluminum, iron, magnesium, and calcium can exhibit a particularly stable effect.

When the polyvalent metal element includes aluminum, the amount of aluminum in the toner particle is preferably from 0.080 μmol/g to 0.400 μmol/g, and more preferably from 0.100 μmol/g to 0.320 μmol/g.

When the polyvalent metal element includes iron, the amount of iron in the toner particle is preferably from 0.270 μmol/g to 1.250 μmol/g, and more preferably from 0.375 μmol/g to 1.000 μmol/g.

When the polyvalent metal element includes magnesium, the amount of magnesium in the toner particle is preferably from 2.000 μmol/g to 20.000 μmol/g, and more preferably from 4.000 μmol/g to 14.000 μmol/g.

When the polyvalent metal element includes calcium, the amount of calcium in the toner particle is preferably from 1.500 μmol/g to 15.000 μmol/g, and more preferably from 2.500 μmol/g to 14.000 μmol/g.

The total amount of the polyvalent metal element in the toner particle is preferably from about 0.100 μmol/g to 21.000 μmol/g.

Setting the content of the polyvalent metal element in the toner particle to the above range is highly effective in causing the accumulated charge on the toner particle surface to propagate into the toner particle in a low-temperature and low-humidity environment, and can suppress the occurrence of fogging due to an excessive charge leakage in a high-temperature and high-humidity environment.

In addition, when the amount of the polyvalent metal element in the toner particle is equal to or more than the abovementioned lower limit, the charge leakage property in a low-temperature and low-humidity environment is stabilized. Meanwhile, when the amount of the polyvalent metal element is equal to or less than the above upper limit, the charging performance in a high-temperature and high-humidity environment is improved.

It is considered that the preferred range of the polyvalent metal element amount differs depending on the substance because of the relation with the valence of the metal. That is, when the valence is high, the ability to coordinate with a carboxy group or the like is high, and therefore, it is considered that the formation of a conductive path is excellent and the charge leakage effect can be exhibited with a small amount of metal. A small amount of trivalent aluminum, a large amount of divalent magnesium and calcium, and an intermediate amount of iron that can take a mixed valence can provide a suitable leakage effect.

The amount of these polyvalent metal elements can be controlled by the amount of the polyvalent metal element-containing substance added at the time of toner particle production.

There is no particular limitation on the means for including the polyvalent metal element into the toner particle. For example, when the toner particle is produced by a pulverization method, the polyvalent metal element may be included in the raw material resin in advance, or the polyvalent metal element may be added to the toner particle when the raw materials are melt-kneaded.

When the toner particle is produced by a wet production method such as a polymerization method, the polyvalent metal element can be included in raw materials or the polyvalent metal element can be added via an aqueous medium in the production process. In the wet production method, it is preferable from the viewpoint of homogenization to include the polyvalent metal element in the toner particle via the state of ionization in an aqueous medium.

This procedure is particularly preferable when the polyvalent metal element is at least one selected from the group consisting of aluminum, iron, magnesium, and calcium, because the ionization tendency is comparatively strong and ionization is facilitated.

There is no particular limitation on the form of the polyvalent metal element when mixing at the time of production, but it is possible to use an element itself or a halide, a hydroxide, an oxide, a sulfide, a carbonate, a sulfate, a hexafluorosilylate, an acetate, a thiosulfate, a phosphate, a chlorate, a nitrate, and the like thereof. As described above, it is preferable to incorporate these in the toner particle via a state of ionization once in an aqueous medium.

The aqueous medium refers to a medium including 50% by mass or more of water and 50% by mass or less of a water-soluble organic solvent. The water-soluble organic solvent can be exemplified by methanol, ethanol, isopropanol, butanol, acetone, methyl ethyl ketone, and tetrahydrofuran.

When the aqueous medium includes hydroxyapatite and the polyvalent metal element is calcium, attention needs to be paid to the addition amount of calcium. The chemical formula of hydroxyapatite is $Ca_{10}(PO_4)_6(OH)_2$, and the ratio of the number of moles of calcium to phosphorus is 1.67. Therefore, under the condition of $M(Ca) \leq 1.67\ M(P)$, where M(Ca) is the number of moles of calcium and M(P) is the number of moles of phosphorus, calcium is easily taken into the hydroxyapatite crystal. Therefore, it is preferable that calcium be present in the aqueous medium in an amount exceeding this amount.

The spherical silica particle used in the present invention will be described hereinbelow.

Examples of the silica particles include wet silica produced from water glass, sol-gel method silica particles obtained by a wet method, gel method silica particles, aqueous colloidal silica particles, alcoholic silica particles, fused silica particles obtained by a gas phase method, and silica particles obtained by a deflagration method. Silica particles obtained by a wet method tend to have moisture adsorption characteristics, and are therefore preferred because they act to suppress charge accumulation in a low-temperature and low-humidity environment.

Among wet silica particles, silica particles obtained by a sol-gel method and having high circularity and a sharp particle size distribution, that is, sol-gel silica particles are particularly preferable.

The amount of spherical silica particle having a number average particle diameter of from 20 nm to 40 nm is preferably from 0.1 parts by mass to 5.0 parts by mass, and more preferably from 0.5 parts by mass to 3.0 parts by mass per 100 parts by mass of the toner particle.

The surface of the silica particle is preferably subjected to a hydrophobic treatment.

A known silane or silazane compound can be used without particular limitation as the silane or silazane compound used for the hydrophobization treatment of the silica particle.

Examples of silane compounds include alkoxysilanes such as methoxysilane, ethoxysilane, and propoxysilane, halosilanes such as chlorosilane, bromosilane, and iodosilane, hydrosilanes, alkylsilanes, arylsilanes, vinylsilanes, acrylic silanes, epoxysilanes, silyl compounds, siloxanes, silyl ureas, silyl acetamides, and silane compounds simultaneously having different substituents contained in these silane compounds.

Silazane compound is a general term for compounds having a Si—N bond in the molecule. Specific examples include dimethyldisilazane, trimethyldisilazane, tetramethyldisilazane, pentamethyldisilazane, hexamethyldisilazane, octamethyltrisilazane, hexamethylcyclotrisilazane, tetraethyltetramethylcyclotetrasilazane, tetraphenyldimethyldisilazane, dipropyltetramethyldisilazane, dibutyltetramethyldisilazane, dihexyltetramethyldisilazane, dioctyltetramethyldisilazane, diphenyltetramethyldisilazane, octamethylcyclotetrasilazane and the like.

Among these, hexamethyldisilazane is preferred from the viewpoint of processing uniformity.

Preferred embodiments of the toner will be described below.

The polyester resin present on the toner particle surface preferably has a weight average molecular weight Mw of from 10000 to 60000, and more preferably from 15000 to 55000. Further, the concentration of the ester groups in the polyester resin is preferably from 20% by mass to 50% by mass, and more preferably from 25% by mass to 45% by mass.

Where the weight average molecular weight Mw is 10000 or more, it is possible to suppress the effect of increasing the charge leakage characteristic due to the terminal polar group, and excellent charge stability in a high-temperature and high-humidity environment is attained.

Meanwhile, where the weight average molecular weight Mw is 55000 or less, the charge due to the triboelectric charge generated on the toner surface can be quickly propagated into the inside of the toner particle, and the charge-up suppressing effect is excellent.

By setting the concentration of the ester groups in the polyester resin to 20% by mass or more, excellent formation of a conductive path to the polyvalent metal elements present in the toner particle is realized, and charge accumulation in a low-temperature and low-humidity environment can be suppressed.

By setting the concentration of the ester groups in the polyester resin to 50% by mass or less, good charge rising characteristics can be maintained even in a high-temperature and high-humidity environment.

The accumulated charge on the toner particle surface can be stably propagated to the polyvalent metal element present in the toner particle, and the charge-up suppressing effect is excellent.

The ester group concentration (% by mass) in the polyester resin in the present invention can be determined as follows. The composition ratio of each monomer of the polyester resin is determined by analyzing the composition of the polyester resin by NMR.

From the obtained monomer composition, the ester group concentration is determined using the following formula. The number of molar equivalents of the carboxy group in the carboxylic acid component is compared with the number of molar equivalents of the hydroxy group in the alcohol component, and the attention is focused on the component (x) having the smaller number of molar equivalents. The monomer mass of the component (x), the monomer molecular weight, the number of functional groups, and also the mass of the produced resin are substituted into the following formula. Where there are two or more types of monomers of the component (x) ($n \geq 2$), the sum total calculated for each is the ester group concentration. The ester group concentration, as referred to in the present invention, means the mass ratio of the ester bond portion "—COO—" (molecular weight 44) in the polyester resin.

$$\text{Ester group concentration (\% by mass)} = \sum_{i=1}^{n}\left[\frac{\frac{Pi}{Ri} \times Si \times 44}{Q} \times 100\right]$$

P: mass (g) of monomer (calculated from the mass of the obtained polyester resin and the molar ratio obtained from the analysis);

Q: mass (g) of the produced resin;

R: molecular weight of monomer;

S: number of functional groups of monomer (when component (x) is an alcohol, it is the number of hydroxy groups, and when component (x) is a carboxylic acid, it is the number of carboxy groups);

n: type (number) of monomer of component (x).

The composition analysis by NMR can be performed, for example, as follows.

The composition of the polyester resin is analyzed using nuclear magnetic resonance spectroscopy ($^1$H-NMR) [400 MHz, $CDCl_3$, room temperature (25° C.)].

Measurement device: FT NMR device JNM-EX400 (manufactured by JEOL Ltd.);

Measurement frequency: 400 MHz;

Pulse condition: 5.0 μs;

Frequency range: 10500 Hz;

Integration count: 64 times.

Composition Analysis of Polyester Resin on Toner Particle Surface Using Toner

Composition analysis of the polyester resin present on the surface of the toner can also be performed by the following method using the toner.

The toner is ultrasonically dispersed in methanol to separate the spherical silica particles and other external additives and allowed to stand for 24 hours. The toner particle can be isolated by separating and collecting the precipitated toner particle and the spherical silica particles and other external additives dispersed in the supernatant liquid, and drying the collected particles sufficiently.

First, the isolated toner particle is confirmed to have a polyester resin on the toner particle surface by TOF-SIMS analysis described hereinbelow.

Then, the toner particle is dissolved in chloroform, and the insoluble matter is removed using, for example, MyShori Disc H-25-2 (manufactured by Tosoh Corporation). Next, a soluble component is introduced into a preparative HPLC (for example, LC-9130 NEXT preparative column [60 cm] manufactured by Japan Analytical Industry Co., Ltd.), and the components collected are subjected to composition analysis by the aforementioned NMR measurement.

In the case where a plurality of types of binder resins are present, the resin present on the toner particle surface is specified by preliminarily separating the surface layer resin component by a multi-step solvent extraction method or Soxhlet extraction using various solvents having different polarities and identifying the component by performing the abovementioned NMR analysis.

When the composition of the polyester resin on the surface is analyzed from the toner to calculate the ester group concentration, P: the mass of the monomer, Q: the mass of the produced resin, and R: the molecular weight of the monomer can be determined as follows.

P and Q can be determined by specifying the molecular structure and molecular weight of the polyester resin by performing the aforementioned NMR analysis. Q can be determined by drying the solvent-extracted components with an evaporator. Where other resin components and the like are contained in the extracted component, the molecular structure and molecular weight of the other resin component can be specified by the aforementioned NMR analysis, and the mass Q of the polyester resin in the extracted component can be obtained.

As the polyester resin, those obtained by condensation polymerization of the following carboxylic acid component and alcohol component can be used.

Examples of the carboxylic acid component include aromatic dicarboxylic acids such as phthalic acid, isophthalic acid and terephthalic acid and anhydrides thereof; alkyl dicarboxylic acids such as succinic acid, adipic acid, sebacic acid and azelaic acid and anhydrides thereof; succinic acid and anhydride thereof substituted with an alkyl or alkenyl group having 6-18 carbon atoms; unsaturated dicarboxylic acids such as fumaric acid, maleic acid and citraconic acid and anhydrides thereof; cyclohexanedicarboxylic acid; and trimellitic acid.

Among these, examples of acid monomer components that can be preferably used include polycarboxylic acids such as terephthalic acid, isophthalic acid, succinic acid, adipic acid, fumaric acid, trimellitic acid, pyromellitic acid, benzophenonetetracarboxylic acid and anhydrides thereof.

Examples of the alcohol component include bisphenol A; hydrogenated bisphenol; alkylene oxide (ethylene oxide, propylene oxide) adducts of bisphenol A such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis(4-hydroxyphenyl)propane; ethylene glycol, diethylene glycol, triethylene glycol, 1,2-propanediol 1,3-propanediol, 1,4-cyclohexanedimethanol, dipropylene glycol, polyethylene glycol, polypropylene glycol, polytetramethylene glycol, sorbit, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanethiol, 2-methyl-1,2,4-butanetriol, trimethylolethane, trimethylolpropane, 1,3,5-trihydroxymethylbenzene, and isosorbide.

Further, the polyester resin may be a polyester resin including a urea group. It is preferable that the carboxy group at the terminal or the like of the polyester resin be not capped.

From the viewpoint of producing a polyester resin having a high ester group concentration, the acid component is preferably at least one carboxylic acid component selected from the group consisting of terephthalic acid, fumaric acid, trimellitic acid and trimellitic anhydride. The alcohol component preferably includes at least one aliphatic alcohol component selected from the group consisting of ethylene glycol and neopentyl glycol.

A method for causing the polyester resin to be present on the toner particle surface can be exemplified by a method using a polyester resin as the binder resin constituting the toner particle. That is, the binder resin preferably includes a polyester resin, and the binder resin is more preferably a polyester resin. The amount of the polyester resin in the binder resin is preferably 50% by mass to 100% by mass, more preferably 80% by mass to 100% by mass, and even more preferably 90% by mass to 100% by mass.

Another example is a method in which a polyester resin is caused to be present in the shell layer of a toner particle having a core-shell structure. That is, the toner particle preferably has a core-shell structure, the shell layer preferably includes a polyester resin, and the shell layer is more preferably a polyester resin. The amount of the polyester resin in the shell layer is preferably 50% by mass to 100% by mass, more preferably 80% by mass to 100% by mass, and even more preferably 90% by mass to 100% by mass.

The abundance of the polyester resin on the toner particle surface can be confirmed by a secondary ion fragment ratio by TOF-SIMS analysis described hereinbelow.

A ratio (EI/ZI) of the sum of the intensities (EI) of ion fragments derived from the ester groups to the sum of the intensities (ZI) of ion fragments derived from the resin on the toner particle surface, which is determined by time-of-flight secondary ion mass spectrometry TOF-SIMS, is preferably from 0.50 to 1.00, more preferably from 0.70 to 1.00, and even more preferably from 0.90 to 1.00.

The acid value of the polyester resin is preferably from 5 mg KOH/g to 20 mg KOH/g.

Further, it is preferable that the toner particle include a wax. In cross-sectional observation of the toner using a transmission electron microscope, it is preferable that wax domains be observed in a cross section of a toner particle, and that As be from 5% to 40%, where As is a ratio of an area occupied by the wax in a region from the surface of the toner particle to 1.0 μm inside. As is more preferably from 7% to 35%. As can be controlled by the amount of wax added, the timing of wax addition in the toner particle production process, the combined use of a wax dispersant, and the like.

It was found that wax present inside the toner particle and closer to the surface promotes softening of the binder resin at the time of fixing and contributes to improving the low-temperature fixability and preventing the offset property, but causes problems with environmental charging characteristic.

In the present invention, even in the state where wax is present relatively in the vicinity of the surface, it is possible to suppress and compensate for a decrease in charge rising performance by a spacer effect and rolling effect of spherical silica particle having a diameter from 20 nm to 40 nm.

By setting As to be from 5% to 40%, it is possible to provide a toner having a low-temperature fixing characteristic, which is excellent in a charge-up suppressing effect in a low-temperature and low-humidity environment and excellent in charge rising performance in a high-temperature and high-humidity environment.

Hereinafter, the components of the toner particle will be described.

Binder Resin

The toner particle includes a binder resin. The binder resin is not particularly limited, and a conventionally known binder resin can be used.

The binder resin is preferably a vinyl resin or a polyester resin. More preferably, it is a polyester resin. The following resins or polymers can be exemplified as the vinyl-based resin and other binder resins.

Homopolymers of styrene such as polystyrene and polyvinyl toluene and substituents thereof; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resins, phenolic resins, aliphatic or alicyclic hydrocarbon resins, and aromatic petroleum resin.

These binder resins can be used singly or in combination. Styrene copolymers are preferable.

A polymerizable monomer including a carboxyl group is preferably used for the vinyl resin.

Examples of the polymerizable monomer including a carboxyl group include acrylic acid and methacrylic acid; α-alkyl derivatives or β-alkyl derivatives of acrylic acid or methacrylic acid such as α-ethyl acrylic acid, crotonic acid and the like; unsaturated dicarboxylic acids such fumaric acid, maleic acid, citraconic acid, itaconic acid and the like; unsaturated dicarboxylic acid monoester derivatives such as succinic acid monoacryloyloxyethyl ester, succinic acid monomethacryloyloxyethyl ester, phthalic acid monoacryloyloxyethyl ester, phthalic acid monomethacryloyloxyethyl ester and the like; and the like.

Crosslinking Agent

In order to control the molecular weight of the binder resin constituting the toner particle, a crosslinking agent may be added during polymerization of the polymerizable monomer.

Examples of the crosslinking agent include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester type diacrylate, (MANDA, Nippon Kayaku Co., Ltd.), and the abovementioned compounds is which acrylate is changed to methacrylate.

The addition amount of the crosslinking agent is preferably from 0.001 parts by mass to 15.000 parts by mass with respect to 100 parts by mass of the polymerizable monomer.

Wax

The toner particle may include a wax.

Examples of the wax include petroleum waxes and derivatives thereof such as paraffin wax, microcrystalline wax and petrolatum, montan wax and derivatives thereof, hydrocarbon wax obtained by the Fischer-Tropsch process and derivatives thereof, polyolefin waxes such as polyethylene and polypropylene and derivatives thereof, natural waxes such as carnauba wax and candelilla wax and derivatives thereof, higher aliphatic alcohols, fatty acids such as stearic acid and palmitic acid, and acid amide, ester and ketone thereof, hydrogenated castor oil and derivatives thereof, vegetable waxes, animal waxes and silicone resins. A hydrocarbon wax is preferable.

Incidentally, derivatives include oxides, block copolymers with vinyl monomers, and graft modified products. The amount of the wax is preferably from 5.0 parts by mass to 20.0 parts by mass with respect to 100.0 parts by mass of the binder resin or the polymerizable monomer that produces the binder resin.

Colorant

The toner may include a colorant. The colorant is not particularly limited, and known colorants can be used.

Examples of yellow pigments include yellow iron oxide and condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, and the like, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, 180, 185, 193.

Examples of orange pigments are presented below.

Permanent Orange GTR, Pyrazolone Orange, Vulcan Orange, Benzidine Orange G, Indanthrene Brilliant Orange RK, and Indathrene Brilliant Orange GK.

Examples of red pigments include Indian Red, condensation azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrroles compounds, anthraquinone compounds, quinacridone compounds, basic dye lake compounds, naphthol compounds, benzimidazolone compounds, thioindigo compounds, perylene compounds. Specific examples are presented hereinbelow.

C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 254.

Examples of blue pigments include copper phthalocyanine compounds and derivatives thereof such as Alkali Blue Lake, Victoria Blue Lake, Phthalocyanine Blue, metal-free Phthalocyanine Blue, partial Phthalocyanine Blue chloride, Fast Sky Blue, Indathrene Blue BG and the like, anthraquinone compounds, basic dye lake compound and the like. Specific examples are presented hereinbelow.

C. I. Pigment Blue 1, 7, 15, 15:1, 15:2, 15:3, 15:4, 60, 62, 66.

Examples of purple pigments include Fast Violet B and Methyl Violet Lake.

Examples of green pigments include Pigment Green B, Malachite Green Lake, and Final Yellow Green G. Examples of white pigments include zinc white, titanium oxide, antimony white and zinc sulfide.

Examples of black pigments include carbon black, aniline black, non-magnetic ferrites, magnetite, and those which are colored black by using the abovementioned yellow colorant, red colorant and blue colorant. These colorants can be used singly or in a mixture, or in the form of a solid solution.

If necessary, the colorant may be surface-treated with a substance which does not inhibit polymerization.

The amount of the colorant is preferably from 3.0 parts by mass to 15.0 parts by mass with respect to 100.0 parts by mass of the binder resin or the polymerizable monomer that produces the binder resin.

Charge Control Agent

The toner particle may include a charge control agent. As the charge control agent, known charge control agents can be used. In particular, a charge control agent that has a high charging speed and can stably maintain a constant charge amount is preferable. Further, in the case where the toner particle is produced by a direct polymerization method, a charge control agent that has a low polymerization inhibition property and is substantially not solubilized in an aqueous medium is preferable.

Examples of charge control agents that control the toner particles to be negatively chargeable are presented hereinbelow.

Organometallic compounds and chelate compounds exemplified by monoazo metal compounds, acetylacetone metal compounds, and metal compounds based on aromatic hydroxycarboxylic acids, aromatic dicarboxylic acids, hydroxycarboxylic acids and dicarboxylic acids. Other examples include aromatic hydroxycarboxylic acids, aromatic mono- and polycarboxylic acids and metal salts, anhydrides, esters, phenol derivatives, such as bisphenol, thereof and the like. Furthermore, urea derivatives, metal-containing salicylic acid compounds, metal-containing naphthoic acid compounds, boron compounds, quaternary ammonium salts, and calixarenes can be mentioned.

These charge control agents can be contained singly or in combination of two or more thereof. The addition amount of the charge control agent is preferably from 0.01 parts by mass to 10.00 parts by mass with respect to 100.00 parts by mass of the binder resin.

External Additive

The toner may include, in addition to the spherical silica particle having a number average particle diameter of from 20 nm to 40 nm, a fluidizing agent and a cleaning aid as a so-called external additive in order to improve flowability, charging performance, cleaning property, and the like.

Examples of the external additive include inorganic fine particles such as silica fine particles, alumina fine particles, titanium oxide fine particles and the like.

These can be used singly or in combination of two or more thereof. These inorganic fine particles are preferably subjected to a gloss treatment with a silane coupling agent, a titanium coupling agent, a higher fatty acid, a silicone oil or the like in order to improve heat-resistant storability and environmental stability. The BET specific surface area of the external additive is preferably from 10 $m^2/g$ to 450 $m^2/g$.

The BET specific surface area can be determined by a low-temperature gas adsorption method based on a dynamic constant pressure method according to a BET method (preferably a BET multipoint method). For example, the BET specific surface area ($m^2/g$) can be calculated by adsorbing nitrogen gas on the surface of a sample and performing measurement by the BET multipoint method by using a specific surface area measuring apparatus (trade name: GEMINI 2375 Ver. 5.0, manufactured by Shimadzu Corporation).

The total amount of these various external additives is preferably from 0.05 parts by mass to 5.00 parts by mass with respect to 100 parts by mass of the toner particles. The type and amount of the external additive can be appropriately selected as long as the effect of the present invention is not impaired. Various external additives may be used in combination.

Developer

The toner can be used as a one-component developer, but it may be also mixed with a carrier and used as a two-component developer. In the viewpoint of preferably exhibiting the effects of the present invention, the toner is preferably used as a one-component developer.

As the carrier, magnetic particles composed of conventionally known materials such as metals such as iron, ferrites, magnetite and alloys of these metals with metals such as aluminum and lead can be used. Among them, ferrite particles are preferable. Further, a coated carrier obtained by coating the surface of magnetic particles with a coating agent such as a resin, a resin dispersion type carrier obtained by dispersing magnetic fine powder in a binder resin, or the like may be used as the carrier.

The volume average particle diameter of the carrier is preferably from 15 μm to 100 μm, and more preferably from 25 μm to 80 μm.

Method for Producing Toner Particles

Known methods can be used for producing the toner particles. Thus, a kneading pulverization method or a wet production method can be used. From the viewpoint of uniform particle diameter and shape controllability, the wet production method is preferable. The wet production methods include a suspension polymerization method, a dissolution suspension method, an emulsion polymerization aggregation method, an emulsion aggregation method, and the like, and an emulsion aggregation method is more preferable. That is, the method for producing toner particles comprising a step of aggregating fine particles of the binder resin to form aggregated particles; and a step of fusing the aggregated particles to obtain a toner particle. Also, it is preferable that the toner particle be an emulsion aggregation toner particle. This is because it is easy to ionize the polyvalent metal element in the aqueous medium, and polyvalent metal elements are easily included in the toner particle when aggregating the binder resin.

In the emulsion aggregation method, first, a dispersion liquid of each material such as fine particles of a binder resin and, if necessary, a colorant and a wax is prepared. A dispersion stabilizer is added, if necessary, to the obtained dispersion liquid of each material and dispersed and mixed. Thereafter, a flocculant is added to cause aggregation until a desired toner particle size is obtained, thereby forming aggregated particles. Thereafter or simultaneously with the aggregation, fusion between the binder resin fine particles is induced by heating or the like to obtain toner particle. Furthermore, shape control may be performed by heat as needed.

Here, the fine particles of the binder resin can be composite particles formed of a plurality of layers composed of two or more layers of resins having different compositions. For example, such fine particles can be produced by an emulsion polymerization method, a mini-emulsion polymerization method, a phase inversion emulsification method or the like, or by a combination of several production methods.

In the case where an internal additive is contained in the toner particles, the internal additive may be included in the resin fine particles, or a dispersion of the internal additive fine particles comprising only the internal additive may be separately prepared, and the internal additive fine particles may be aggregated together with the fine resin particles at the time of aggregation. In addition, by aggregating resin fine particles having different compositions by adding with a difference in time at the time of aggregation, it is also possible to prepare toner particles having layer configurations of different compositions.

The following dispersion stabilizer can be used.

Known cationic surfactants, anionic surfactants, and nonionic surfactants can be used as the surfactant.

The inorganic dispersion stabilizer can be exemplified by tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The organic dispersion stabilizer can be exemplified by polyvinyl alcohol, gelatin, methylcellulose, methylhydroxypropylcellulose, ethylcellulose, sodium salt of carboxymethylcellulose, and starch.

From the viewpoint of high definition and high resolution of the image, it is preferable that the weight average particle diameter of the toner particles be from 3.0 to 10.0 μm.

Toner Production Method

A toner can be obtained by adding an external additive to the toner particle. As an example of the external addition device, a double-cone mixer, a V-type mixer, a drum-type mixer, a SUPER mixer, an FM mixer (manufactured by Nippon Coke Industries Co., Ltd.), a NAUTA mixer, MECHANOHYBRID, and the like can be used.

From the viewpoint of uniformly treating spherical silica particles having a number average particle diameter of from 20 nm to 40 nm on the surface of toner particle, an FM mixer (manufactured by Nippon Coke Industries Co., Ltd.) is preferable.

Methods for measuring various physical properties of toner, toner particle, spherical silica particles, and other materials will be described below.

The physical properties of the spherical silica particles are measured using a toner as a sample. Alternatively, when measuring the physical properties of the spherical silica particles and the toner particle from the toner to which the spherical silica particles are externally added, the spherical silica particles and other external additives can be separated from the toner to perform measurements.

In that case, the toner is ultrasonically dispersed in methanol to separate the spherical silica particles and other external additives and left to stand for 24 hours. The toner particle can be isolated by separating and collecting the precipitated toner particle and the spherical silica particles and other external additives dispersed in the supernatant liquid, and drying the toner particle sufficiently. Moreover, spherical silica particles can be isolated by treating the supernatant liquid with centrifugation.

Measurement of Particle Diameter of Toner Particles

The particle diameter of the toner particles can be measured by a fine pore electric resistance method. For example, the measurement and calculation can be performed using "Coulter Counter Multisizer 3" and the dedicated software "Beckman Coulter Multisizer 3 Version 3.51" (manufactured by Beckman Coulter, Inc.).

A precision particle size distribution measuring apparatus (registered trademark, "Coulter Counter Multisizer 3", manufactured by Beckman Coulter, Inc.) based on a pore electric resistance method and the dedicated software "Beckman Coulter Multisizer 3 Version 3.51" (manufactured by Beckman Coulter, Inc.) are used. The measurement is performed using an aperture diameter of 100 μm with 25,000 effective measurement channels, and the measurement data are analyzed and calculated.

A solution prepared by dissolving special grade sodium chloride in ion exchanged water to a concentration of about 1% by mass, for example, "ISOTON II" (trade name) manufactured by Beckman Coulter, Inc., can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using "standard particles 10.0 μm" (manufactured by Beckman Coulter, Inc.) is set as a Kd value. The threshold and the noise level are automatically set by pressing the measurement button of the threshold/noise level. Further, the current is set to 1600 μA, the gain is set to 2, the electrolytic solution is set to ISOTON II (trade name), and "FLUSH OF APERTURE TUBE AFTER MEASUREMENT" is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) Approximately 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water is added.

(3) A predetermined amount of ion exchanged water is placed in the water tank of an ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees, and about 2 mL of CONTAMINON N (trade name) is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particles) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner (particles) is dispersed is dropped using a pipette into the round bottom beaker of (1) hereinabove which has been set in the sample stand, and the measurement concentration is adjusted to be about 5%. Then, measurement is conducted until the number of particles to be measured reaches 50000.

(7) The measurement data are analyzed with the dedicated software provided with the apparatus, and the weight average particle diameter (D4) is calculated. The "AVERAGE DIAMETER" on the "ANALYSIS/VOLUME STATISTICAL VALUE (ARITHMETIC MEAN)" screen when the special software is set to graph/volume % is the weight average particle diameter (D4). The "AVERAGE DIAMETER" on the "ANALYSIS/NUMBER STATISTICAL VALUE (ARITHMETIC MEAN)" screen when the special software is set to graph/number % is the number average particle diameter (D1).

Number Average Particle Diameter of Primary Particles of Spherical Silica Particles The number average particle size of the primary particles of the spherical silica particles is measured using a transmission electron microscope "JEM-2800" (JEOL Ltd.). The toner to which the spherical silica fine particles have been externally added is observed, and in the field of view enlarged up to 200,000 times, the major axis of the primary particle of 100 spherical silica particles is randomly measured to obtain the number average particle size. The observation magnification is appropriately adjusted depending on the size of the spherical silica particles.

The spherical silica particles can be distinguished from external additives of the toner by elemental analysis of the toner particle surface by using an X-ray photoelectron spectroscopy device described hereinbelow. Further, spherical silica particles on the toner particle surface can be measured separately from non-spherical silica particles by using image analysis software according to the measurement of circularity described hereinbelow.

In addition, when spherical silica particles before external addition are available, the number average particle diameter can be calculated by the above method using such particles, and an alternative possibility is to distinguish the isolated spherical silica particles by performing elemental analysis, as described above.

Method for Measuring Circularity of Spherical Silica Particles

The circularity of the spherical silica particles is calculated by using image analysis software ImageJ (developer: Wayne Rashand) to analyze observation images of spherical silica particles captured with Hitachi Ultra High Resolution Field Emission Scanning Electron Microscope S-4800 (Hitachi High-Technologies Corporation). The measurement procedure is shown below.

(1) Sample Preparation

A thin layer of conductive paste is applied to a sample table (aluminum sample table 15 mm×6 mm), and spherical silica particles are deposited thereon. Using a blower, the excess spherical silica particles are air-blown followed by sufficient drying. The sample stage is set on the sample holder.

Further, when measuring spherical silica particles having high cohesiveness, spherical silica particles to be measured are mixed in advance with methanol and ultrasonically dispersed, and the solvent is removed to obtain a measurement sample.

(2) S-4800 Observation Conditions

Observation conditions are shown below.

Acceleration voltage: 1 kV

Emission current: 10 μA

Detector: [on SE (U)], [+BSE (L.A.100)]

Probe current: [High]

Focus mode: [UHR]

WD: [3.0 mm]

(3) Image Storage

Brightness is adjusted in an ABC mode, and an image is captured with a size of 1280×960 pixels and saved. The following analysis is performed using this image file. The observation magnification is appropriately adjusted according to the size of the fine particle that is the observation target.

(4) Image Analysis

From the obtained SEM observation image, the circularity is calculated using image processing software ImageJ (developer: Wayne Rashand). The calculation procedure is shown below.

[1] A scale is set with [Analyze]-[Set Scale].

[2] A threshold is set with [Image]-[Adjust]-[Threshold]. (Setting to a value at which noise does not remain and the spherical silica particle to be measured remains.)

[3] In [Image]-[Crop], the measured image portion of the spherical silica particle is selected.

[4] The overlapping particles are erased by image editing.

[5] The monochrome image is inverted with [Edit]-[Invert].

[6] [Area] and [Shape Descriptors] are checked with [Analyze]-[Set Measurements]

Also, [Redirect to] is set to [None], and

[Decimal Place (0-9)] is set to 3.

[7] The area of the particle is indicated to be 0.0005 $\mu m^2$ or more and analysis is performed with [Analyze]-[Analyze Particle].

[8] The value of circularity of each particle is obtained.

[9] Measurement is performed on 100 or more particles observed, and an arithmetic average value of the obtained circularity is calculated to obtain circularity.

Noise in the enlarged image can be removed by a method involving setting [Radius] in [Process]-[Filter]-[Median] to 2.0 Pixels before setting [Threshold] in [2].

The formula for circularity is $4\pi\times$(area)/(second power of circumference). When the circularity is 1, it indicates a perfect circle.

Measurement of Circularity Using Toner

When measuring the circularity of the spherical silica particles contained in the toner, the measurement can be performed by attaching the toner to the sample stage by the same procedure as described above.

The measurement can be performed in the same manner for a toner in which a plurality of types of fine particles are contained on the toner particle surface. When the reflected electron image is observed in S-4800, the elements of each fine particle can be specified using elemental analysis such as EDAX. Further, it is possible to select fine particles of the same kind from the shape characteristics and the like. By performing the above measurement on fine particles of the same kind, the circularity of fine particles for each kind can be calculated.

Amount of Polyvalent Metal Element in Toner Particle (ICP-AES)

The amount of the polyvalent metal element in the toner particle is quantitatively determined by an inductively-coupled plasma emission spectroscopic analyzer (ICP-AES (manufactured by Seiko Instruments Inc.)).

As pretreatment, acid decomposition is carried out using 8.00 mL of 60% nitric acid (manufactured by Kanto Chemical Co., Inc., for atomic absorption spectroscopy) with respect to 100.0 mg of toner particles.

At the time of acid decomposition, the treatment is carried out for 1 h in a sealed container at an internal temperature of 220° C. by a microwave high-power sample pretreatment apparatus ETHOS 1600 (manufactured by Milestone General Co., Ltd.) to prepare a sample of solution including a polyvalent metal element.

Thereafter, ultrapure water is added so that the total amount becomes 50.00 g to obtain a measurement sample. A calibration curve is prepared for each polyvalent metal element, and the amount of metal contained in each sample is quantitatively determined. Ultrapure water is added to 8.00 mL of nitric acid to make 50.00 g as a whole, the solution obtained is measured as a blank, and the amount of metal in the blank is subtracted.

Calculation of As

The wax distribution state in the toner is evaluated by observing the cross section of the toner with a transmission electron microscope, calculating As from the cross sectional area of the domain formed by the wax, and calculating an average value of 10 arbitrarily selected toners. Specifically, the toner is embedded in a visible light curable embedding resin (D-800, manufactured by Nisshin EM Co., Ltd.), cut to a thickness of 60 nm by an ultrasonic ultramicrotome (EMS, manufactured by Leica), and Ru-stained (staining with $RuO_4$ gas for 15 min in a 500 Pa atmosphere) with vacuum staining equipment (manufactured by Filgen, Inc.).

Thereafter, observation is performed with a transmission electron microscope (H7500, manufactured by Hitachi, Ltd.) at an acceleration voltage of 120 kV. For the cross section of the toner to be observed, images are captured by selecting 10 particles with a diameter within ±2.0 μm from a weight average particle diameter. An image processing software (Photoshop 5.0, manufactured by Adobe) is used for the obtained image, and tone gradation in two stages is adjusted by adjusting the threshold to clarify the distinction between the wax domain and the binder resin region.

Masking is performed by leaving a region from the surface (cross-sectional contour) of the toner particle to 1.0 μm inside (including the boundary of 1.0 μm), and the occupied area percentage of the wax domains in the area of the remaining region is calculated. The average value of 10 toner particles is defined as As (area %).

Measurement of Polyester Resin on Toner Particle Surface

Where the polyester resin has a structure derived from phthalic acid, isophthalic acid or terephthalic acid, measurement of the polyester resin on the toner particle surface using time-of-flight secondary ion mass spectrometry (TOF-SIMS) can be performed by TRIFT-IV (manufactured by ULVAC-PHI). The analysis conditions are as follows.

Sample preparation: a toner particle is caused to adhere to an indium sheet. A toner particle obtained by separating external additives such as silica particles from the toner may be used as a sample.

Sample pretreatment: none

Primary ion: $Au^+$

Acceleration voltage: 30 kV

Charge neutralization mode: On

Measurement mode: Positive

Raster: 100 μm

Calculation of peak intensity (EI) derived from phthalic acid, isophthalic acid or terephthalic acid including an ester group: according to ULVAC-PHI standard software (Win Cadense), the total count peak number of mass number 148 to 150 is taken as peak intensity (EI).

Calculation of other resin-derived peak intensities: according to ULVAC-PHI standard software (Win Cadense), the total count peak number of mass numbers 90 to 105 is taken as other resin-derived peak intensity. The sum of this peak intensity and the peak intensity (EI) derived from phthalic acid, isophthalic acid or terephthalic acid including the ester group is taken as the peak intensity (ZI) derived from the resin on the toner particle surface.

EI/ZI is calculated from the abovementioned peak intensities. When EI/ZI is 0.50 or more, it is determined that the polyester resin is present on the toner particle surface.

Method for Measuring the Weight-Average Molecular Weight (Mw) of the Resins

The weight-average molecular weight (Mw) of the polyester resin and so on are measured as follows using gel permeation chromatography (GPC).

First, the sample (resin) is dissolved in tetrahydrofuran (THF) for 24 hours at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of approximately 0.8 mass %. Measurement is carried out under the following conditions using this sample solution.

instrument: HLC8120 GPC (detector: RI) (Tosoh Corporation)

column: 7-column train of Shodex KF-801, 802, 803, 804, 805, 806, and 807 (Showa Denko Kabushiki Kaisha)

eluent: tetrahydrofuran (THF)

flow rate: 1.0 mL/min oven temperature: 40.0° C.

amount of sample injection: 0.10 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring the Acid Value of the Resins

The acid value of the resin and so on are measured as follows. The acid value is the number of milligrams of potassium hydroxide required to neutralize the acid present in 1 g of a sample. The acid value of the binder resin is measured in accordance with JIS K 0070-1992, and is specifically measured using the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of the pulverized sample is exactly weighed into a 200-mL Erlenmeyer flask and 100 mL of a toluene/ethanol (2:1) mixed solution is added and dissolution is carried out over 5 hours. Several drops of the phenolphthalein solution are added as indicator and titration is performed using the potassium hydroxide solution. The titration endpoint is taken to be the persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: mass of the sample (g).

EXAMPLES

Hereinafter, the present invention will be specifically described with reference to examples, but the present invention is not limited to these examples. In the examples and comparative examples, all "parts" are based on mass unless otherwise specified.

In order to clearly show the effect of the present invention which is due to the features of the present invention, in the examples and comparative examples of the present invention, developing performance evaluation and fixing performance evaluation are performed assuming that the weight average particle diameter of the toner particles is 6.0 μm.

Production Example of Polyester Resin 1

A total of 47 mol parts of terephthalic acid, 3 mol parts of isophthalic acid, 26 mol parts of ethylene oxide-modified bisphenol A (2 mol adduct), 18 mol parts of ethylene glycol, and 1000 ppm of tetrabutoxytitanium were placed in a reactor equipped with a stirrer, a thermometer, and an outlet cooler, and an esterification reaction was carried out at 190° C. Thereafter, 6 mol parts of trimellitic anhydride (TMA) was added, the temperature was raised to 220° C., the pressure inside the system was gradually reduced, and a polycondensation reaction was performed at 150 Pa to obtain a polyester resin 1. Table 1 shows the physical properties of the obtained polyester resin 1.

Production Examples of Polyester Resins 2 to 5

Polyester resins 2 to 5 were obtained by changing the monomers described in the Production Example of Polyester Resin 1 to the monomers shown in Table 1 and changing the addition amount of tetrabutoxytitanium, the reaction temperature, and the reaction time. Table 1 shows the physical properties.

TABLE 1

| Polyester | Monomer composition | | | | | | | | Physical properties | | | |
|---|---|---|---|---|---|---|---|---|---|---|---|---|
| | | | | | | | | | Ester group concentration | | Softening temperature | Acid |
| resin No. | TPA | IPA | FA | TMA | BPA-EO | BPA-PO | EG | NG | (% by mass) | Mw | ° C. | value |
| 1 | 47 | 3 | — | 6 | 26 | — | 18 | — | 30 | 40000 | 118 | 16 |
| 2 | 40 | 7 | — | 3 | 45 | 5 | — | — | 20 | 60000 | 123 | 7 |
| 3 | 37 | — | 7 | 6 | — | — | 48 | 2 | 50 | 10000 | 112 | 12 |
| 4 | 40 | 8 | — | — | — | 50 | — | — | 17 | 70000 | 125 | 4 |
| 5 | 21 | — | 25 | 4 | — | — | 50 | — | 55 | 5000 | 103 | 10 |

The unit of the acid value is mg KOH/g.

Abbreviations in the table are as follows.

TPA: Terephthalic acid

IPA: Isophthalic acid

FA: Fumaric acid

TMA: Trimellitic anhydride

BPA-EO: ethylene oxide-modified bisphenol A (2 mol adduct)

BPA-PO: propylene oxide-modified bisphenol A (2 mol adduct)

EG: Ethylene glycol

NG: Neopentyl glycol

Production Example of Silica Particles 1

A total of 500 parts of methanol and 70 parts of 10% by mass ammonia water were added and mixed in a 1.5 L glass reaction vessel equipped with a stirrer, a dropping nozzle, and a thermometer to obtain an alkali catalyst solution.

After adjusting the alkali catalyst solution to 30° C., 100 parts of tetramethoxysilane (TMOS) and 20 parts of 8.0% by mass ammonia water were dropped simultaneously over 60 min while stirring to obtain a hydrophilic silica particle-dispersed solution.

Thereafter, the obtained silica particle dispersion was concentrated to a solid fraction concentration of 50% by mass with a rotary filter R-Fine (manufactured by Kotobuki Industries Co., Ltd.) to obtain a silica particle-dispersed solution.

After adding 50 parts of hexamethyldisilazane (HMDS) as a hydrophobizing agent to 250 parts of the silica particle-dispersed solution and reacting at 130° C. for 2 hours, cooling and then spray drying were performed to obtain silica particles 1. Table 2 shows the physical properties of the obtained silica particles 1.

Production Examples of Silica Particles 2, 3, 5, and 6

Spherical silica particles 2, 3, 5, and 6 were prepared by changing the adjustment temperature and addition amount of the alkali catalyst solution and the dropping time of tetramethoxysilane in the production of silica particles 1. Table 2 shows the physical properties of the obtained silica particles 2, 3, 5, and 6.

Silica Particles 4

As silica particles 4, fused silica "UFP-80" (manufactured by Denka Co., Ltd.), which was obtained by melting pulverized raw material silica in a high-temperature flame and making it spherical by surface tension, was used. Table 2 shows the physical properties of the silica fine particles 4.

Silica Particles 7

As the silica particles 7, fumed silica "HDK H18" (manufactured by Wacker Co., Ltd.), which was obtained by subjecting silica particles produced by a combustion method to hydrophobization with an alkylsilane, was used. Table 2 shows the physical properties of the silica particles 7.

TABLE 2

| Silica particles No. | Type | Number average particle diameter (nm) | Circularity |
|---|---|---|---|
| 1 | Sol-gel silica | 30 | 0.91 |
| 2 | Sol-gel silica | 20 | 0.92 |
| 3 | Sol-gel silica | 40 | 0.90 |
| 4 | Fused silica | 34 | 0.94 |
| 5 | Sol-gel silica | 16 | 0.92 |
| 6 | Sol-gel silica | 43 | 0.89 |
| 7 | Fumed silica | 20 | 0.75 |

Preparation of Resin Particle-Dispersed Solution 1

A total of 100.0 parts of the polyester resin 1 and 350 parts of ion exchanged water were put in a stainless steel container, heated to 95° C. in a hot bath and melted, and 0.1 mol/L sodium bicarbonate was added, while thoroughly stirring at 7800 rpm using a homogenizer (manufactured by IKA: Ultra Turrax T50), to increase pH above 7.0.

Thereafter, a mixed solution of 3 parts of sodium dodecylbenzenesulfonate and 300 parts of ion exchanged water was gradually added dropwise, and emulsification and dispersion were performed to obtain a polyester resin particle-dispersed solution. The dispersion liquid was cooled to room temperature, and ion exchanged water was added to obtain a resin particle-dispersed solution 1 having a solid fraction concentration of 12.5% by mass and a volume-based median diameter of 0.2 μm.

Preparation of Resin Particle-Dispersed Solutions 2 to 5

Resin particle-dispersed solutions 2 to 5 having a solid fraction concentration of 12.5% by mass and a volume-based median diameter of 0.2 μm were prepared in the same manner as in the preparation of the resin fine particle-dispersed solution 1, except that the polyester resin 1 to be added was changed to polyester resins 2 to 5.

Preparation of Resin Particle-Dispersed Solution 6

A total of 78.0 parts of styrene, 20.7 parts of butyl acrylate, 1.3 parts of acrylic acid as a carboxyl group-providing monomer, and 3.2 parts of n-lauryl mercaptan were mixed and dissolved. To this solution, an aqueous solution of 1.5 parts of NEOGEN RK (Daiichi Kogyo Seiyaku Co., Ltd.) in 150 parts of ion exchanged water was added followed by dispersing.

Further, an aqueous solution of 0.3 part of potassium persulfate in 10 parts of ion exchanged water was added while stirring slowly for 10 min. After purging with nitrogen, emulsion polymerization was performed at 70° C. for 6 hours. After the completion of the polymerization, the reaction solution was cooled to room temperature, and ion exchanged water was added to obtain a resin particle-dispersed solution 6 having a solid content of 12.5% by mass and a volume-based median diameter of 0.2

Preparation of Wax-Dispersed Solution

A total of 100 parts of a hydrocarbon wax (melting point: 77° C.) and 15 parts of NEOGEN RK were mixed with 385 parts of ion exchanged water and dispersed for about 1 hour using a wet jet mill JN100 (manufactured by JOKOH Co., Ltd.) to obtain a wax-dispersed solution. The concentration of the wax-dispersed solution was 20% by mass.

Preparation of Colorant-Dispersed Solution 1

C. I. Pigment Blue 15:3 (100 parts) and 15 parts of NEOGEN RK were mixed with 885 parts of ion exchanged water and dispersed using the wet jet mill JN100 for about 1 hour to obtain a colorant-dispersed solution 1.

Preparation of Colorant-Dispersed Solution 2

C. I. Pigment Yellow 74 (100 parts) and 15 parts of NEOGEN RK were mixed with 885 parts of ion exchanged water and dispersed using the wet jet mill JN100 for about 1 hour to obtain a colorant-dispersed solution 2.

Preparation of Colorant-Dispersed Solution 3

C. I. Pigment Red 122 (100 parts) and 15 parts of NEOGEN RK were mixed with 885 parts of ion exchanged water and dispersed using the wet jet mill JN100 for about 1 hour to obtain a colorant-dispersed solution 3.

Preparation of Colorant-Dispersed Solution 4

A total of 100 parts of carbon black "NIPEX 35 (manufactured by Orion Engineered Carbons)" as a colorant and 15 parts of NEOGEN RK were mixed with 885 parts of ion exchanged water and dispersed using a wet jet mill JN 100 for about 1 h to obtain a colorant-dispersed solution 4.

Production Example of Toner Particles 1

A total of 265 parts of the resin particle-dispersed solution 1, 20 parts of the wax-dispersed solution and 20 parts of the colorant-dispersed solution 1 were dispersed using a homogenizer (ULTRA TURRAX T50, manufactured by IKA Works, Inc.). The temperature inside the vessel was adjusted to 30° C. under stirring, and 1 mol/L sodium hydroxide aqueous solution was added to adjust the pH to 8.0 (pH adjustment 1).

As a flocculant, an aqueous solution prepared by dissolving 0.23 parts of aluminum chloride in 10 parts of ion exchanged water was added over 10 min under stirring at 30° C. After allowing to stand for 3 min, the temperature was started to raise, and the temperature was raised to 50° C. to generate associated particles. In that state, the particle diameter of associated particles was measured with "Coulter Counter Multisizer 3" (registered trademark, manufactured by Beckman Coulter, Inc.). When the weight average particle diameter reached 6.0 μm, 0.9 parts of sodium chloride and 5.0 parts of NEOGEN RK were added to stop the particle growth.

A 1 mol/L sodium hydroxide aqueous solution was added to adjust the pH to 9.0, then the temperature was raised to 95° C., and the aggregated particles were spheroidized. When the average circularity reached 0.980, the temperature was started to be lowered, and cooling was performed to room temperature to obtain a toner particle dispersion 1.

Hydrochloric acid was added to the resultant toner particle dispersion 1 to adjust the pH to 1.5 or less, and after stirring for 1 h, solid-liquid separation was performed by a pressure filter to obtain a toner cake. This was re-slurried with ion exchanged water to prepare a dispersion again, followed by solid-liquid separation with the aforementioned filter. The re-slurrying and solid-liquid separation were repeated until the electric conductivity of the filtrate became 5.0 μS/cm or less, and finally the solid-liquid separation was performed to obtain a toner cake. The obtained toner cake was dried and further classified using a classifier so as to have a weight average particle diameter of 6.0 μm, thereby obtaining toner particles 1.

Production Example of Toner Particle 2

A toner particle 2 was obtained in the same manner as the toner particle 1 except that the flocculant was changed from aluminum chloride to iron (III) chloride and the number of added parts was 0.36 parts.

Production Example of Toner Particle 3

A toner particle 3 was obtained in the same manner as the toner particle 1 except that the flocculant was changed from aluminum chloride to magnesium sulfate and the number of added parts was 1.20 parts.

Production Example of Toner Particle 4

A toner particle 4 was obtained in the same manner as the toner particle 1 except that the flocculant was changed from aluminum chloride to calcium chloride and the number of added parts was 1.50 parts.

Production Example of Toner Particle 5

A toner particle 5 was obtained in the same manner as the toner particle 1 except that 0.36 part of iron (III) chloride was added simultaneously in addition to the aluminum chloride added as a flocculant.

Production Example of Toner Particle 6

A toner particle 6 was obtained in the same manner as the toner particle 1 except that the flocculant was changed from aluminum chloride to magnesium sulfate and calcium chloride, and the number of added parts was 1.20 parts and 1.50 parts, respectively.

Production Example of Toner Particle 7

A toner particle 7 was obtained in the same manner as the toner particle 1 except that the flocculant was changed from aluminum chloride to iron (III) chloride, magnesium sulfate and calcium chloride, and the number of added parts was 0.36, 1.20 and 1.50 parts, respectively.

Production Example of Toner Particle 8

A toner particle 8 was obtained in the same manner as the toner particle 1 except that in the Production Example of Toner Particle 1, the colorant-dispersed solution 1 to be added was changed to the colorant-dispersed solution 2.

Production Example of Toner Particle 9

A toner particle 9 was obtained in the same manner as the toner particle 1 except that in the Production Example of Toner Particle 1, the colorant-dispersed solution 1 to be added was changed to the colorant-dispersed solution 3.

Production Example of Toner Particle 10

A toner particle 10 was obtained in the same manner as the toner particle 1 except that in the Production Example of Toner Particle 1, the colorant-dispersed solution 1 to be added was changed to the colorant-dispersed solution 4.

Production Example of Toner Particle 11

A toner particle 11 was obtained in the same manner as the toner particle 1 except that in the Production Example of Toner Particle 1, the resin particle-dispersed solution 1 to be added was changed to the resin particle-dispersed solution 2, the addition timing of the wax-dispersed solution was delayed, and the addition amount of aluminum chloride added as the flocculant was changed to 0.12 parts.

Production Example of Toner Particle 12

A toner particle 12 was obtained in the same manner as the toner particle 1 except that in the Production Example of Toner Particle 1, the resin particle-dispersed solution 1 to be added was changed to the resin particle-dispersed solution 3, the addition amount of the wax-dispersed solution was changed from 20 parts to 10 parts, and the addition amount of aluminum chloride added as the flocculant was changed to 0.35 parts.

Production Example of Toner Particle 13

A toner particle 13 was obtained in the same manner as the toner particle 1 except that the flocculant was changed from aluminum chloride to iron (III) chloride and the number of added parts was 0.21 parts.

Production Example of Toner Particle 14

A toner particle 14 was obtained in the same manner as the toner particle 1 except that the flocculant was changed from aluminum chloride to iron (III) chloride and the number of added parts was 0.50 parts.

Production Example of Toner Particle 15

A toner particle 15 was obtained in the same manner as the toner particle 1 except that the flocculant was changed from aluminum chloride to magnesium sulfate and the number of added parts was 0.60 parts.

Production Example of Toner Particle 16

A toner particle 16 was obtained in the same manner as the toner particle 1 except that the flocculant was changed from aluminum chloride to magnesium sulfate and the number of added parts was 1.90 parts.

Production Example of Toner Particle 17

A toner particle 17 was obtained in the same manner as the toner particle 1 except that the flocculant was changed from aluminum chloride to calcium chloride and the number of added parts was 0.70 parts.

Production Example of Toner Particle 18

A toner particle 18 was obtained in the same manner as the toner particle 1 except that the flocculant was changed from aluminum chloride to calcium chloride and the number of added parts was 2.45 parts.

Production Example of Toner Particle 19

A toner particle 19 was obtained in the same manner as the toner particle 1 except that in the Production Example of Toner Particle 1, the addition amount of aluminum chloride was changed to 0.09 parts.

Production Example of Toner Particle 20

A toner particle 20 was obtained in the same manner as the toner particle 1 except that in the Production Example of Toner Particle 1, the addition amount of aluminum chloride was changed to 0.39 parts.

Production Example of Toner Particle 21

A toner particle 21 was obtained in the same manner as the toner particle 1 except that the flocculant was changed from aluminum chloride to iron (III) chloride and the number of added parts was 0.20 parts.

Production Example of Toner Particle 22

A toner particle 22 was obtained in the same manner as the toner particle 1 except that the flocculant was changed from aluminum chloride to iron (III) chloride and the number of added parts was 0.52 parts.

Production Example of Toner Particle 23

A toner particle 23 was obtained in the same manner as the toner particle 1 except that the flocculant was changed from aluminum chloride to magnesium sulfate and the number of added parts was 0.55 parts.

Production Example of Toner Particle 24

A toner particle 24 was obtained in the same manner as the toner particle 1 except that the flocculant was changed from aluminum chloride to magnesium sulfate and the number of added parts was 1.95 parts.

Production Example of Toner Particle 25

A toner particle 25 were obtained in the same manner as the toner particle 1 except that the flocculant was changed from aluminum chloride to calcium chloride and the number of added parts was 0.60 parts.

Production Example of Toner Particle 26

A toner particle 26 was obtained in the same manner as the toner particle 1 except that the flocculant was changed from aluminum chloride to calcium chloride and the number of added parts was 2.50 parts.

Production Example of Toner Particle 27

A toner particle 27 was obtained in the same manner as the toner particle 19 except that in the Production Example of Toner Particle 19, the resin particle-dispersed solution 1 to be added was changed to the resin particle-dispersed solution 4.

Production Example of Toner Particle 28

A toner particle 28 was obtained in the same manner as the toner particle 26 except that in the Production Example of Toner Particle 26, the resin particle-dispersed solution 1 to be added was changed to the resin particle-dispersed solution 5.

Production Example of Toner Particle 29

A toner particle 29 was obtained in the same manner as in the Production Example of Toner Particle 21 except that the addition timing of the wax-dispersed solution was delayed.

Production Example of Toner Particle 30

A toner particle 30 was obtained in the same manner as in the Production Example of Toner Particle 24 except that the addition amount of the wax-dispersed solution from 20 parts to 6 parts.

Production Example of Toner Particle 31

| Production Example of Toner Particle 31 | |
|---|---|
| Polyester resin 1 | 100.0 parts |
| Methyl ethyl ketone | 80.0 parts |
| Ethyl acetate | 80.0 parts |
| Hydrocarbon wax (Fischer-Tropsch wax, maximum endothermic peak = 78° C.) | 12.0 parts |
| C.I. Pigment Blue 15:3 | 6.0 parts |
| Charge control resin (FCA-N, manufactured by Fujikura Kasei Co., Ltd. ) | 1.0 part |
| Sodium dodecylbenzenesulfonate | 0.5 parts |

The above materials were dispersed using an attritor (manufactured by Mitsui Kinzoku Co., Ltd.) for 3 hours and allowed to stand for 72 hours to obtain a mixed colorant-dispersed solution.

Meanwhile, after adding 0.5 parts of aluminum chloride to 220 parts of ion exchanged water and heating to 65° C., 20 parts of 1.0 mol/L-$CaCl_2$ aqueous solution was gradually added to obtain an aqueous medium.

The colorant-dispersed solution was loaded into the aqueous medium, and stirred at 12000 rpm for 15 minutes with a TK homomixer at a temperature of 65° C. in an $N_2$ atmosphere to granulate the colorant-dispersed solution. Thereafter, the internal temperature was rapidly raised to 30° C. and held for 12 hours to remove the solvent, and an aqueous medium in which resin particles were dispersed was obtained.

Hydrochloric acid was added to the aqueous medium in which resin particles were dispersed to adjust the pH to 1.4, and the dispersant was dissolved by stirring for 1 hour. The dispersion liquid was filtered with a pressure filter, and the resulting wet toner particle was washed to obtain a toner cake. Thereafter, the toner cake was crushed and dried to obtain toner particle 31.

Production Example of Toner Particle 32

A toner particle 32 was obtained in the same manner as the toner particle 1 except that in the Production Example of Toner Particle 1, the resin particle-dispersed solution 1 to be added was changed to the resin particle-dispersed solution 6.

Production Example of Toner Particle 33

A toner particle 33 was obtained in the same manner as in the Production Example of Toner Particle 1 except that the amount of aluminum chloride added was changed to 0.15 parts, and when the weight average particle diameter reached 6.0 μm, 50 parts of the resin particle-dispersed solution 6 and 0.08 parts of aluminum chloride were further added.

Production Example of Toner Particle 34

A toner particle 34 was obtained in the same manner as the toner particle 1 except that aluminum chloride to be added as a flocculant was changed to 500 parts of 1-pentanol that was dropped over 1 hour.

Production Example of Toner Particle 35

A toner particle 35 was obtained in the same manner as the toner particle 1 except that in the Production Example of Toner Particle 1, the addition amount of aluminum chloride was changed to 0.07 parts.

Production Example of Toner Particle 36

A toner particle 36 was obtained in the same manner as the toner particle 1 except that the flocculant was changed from aluminum chloride to iron (III) chloride and the number of added parts was changed to 0.16 parts.

Production Example of Toner Particle 37

A toner particle 37 was obtained in the same manner as the toner particle 1 except that the flocculant was changed from aluminum chloride to magnesium sulfate and the number of added parts was changed to 0.40 parts.

Production Example of Toner Particle 38

A toner particle 38 was obtained in the same manner as the toner particle 1 except that the flocculant was changed from aluminum chloride to magnesium sulfate and calcium chloride, and the addition amounts were 0.35 parts and 0.30 parts, respectively.

Production Example of Toner Particle 39

A toner particle 39 was obtained in the same manner as the toner particle 1 except that the addition amount of aluminum chloride as the flocculant to be added was changed to 0.35 parts, and 0.50 parts of iron (III) chloride, 1.20 parts of magnesium sulfate and 1.50 parts of calcium chloride were further added.

Production Example of Toner Particle 40

A toner particle 40 was obtained in the same manner as the toner particle 1 except that in the Production Example of Toner Particle 1, the addition amount of aluminum chloride added as a flocculant was changed to 12.50 parts.

Production Example of Toner Particle 41

A toner particle 41 was obtained in the same manner as the toner particle 1 except that the flocculant was changed from aluminum chloride to iron (III) chloride and the number of added parts was changed to 12.00 parts.

Production Example of Toner Particle 42

A toner particle 42 was obtained in the same manner as the toner particle 1 except that the flocculant was changed from aluminum chloride to magnesium sulfate and the number of added parts was changed to 2.00 parts.

Production Example of Toner Particle 43

A toner particle 43 was obtained in the same manner as the toner particle 1 except that the flocculant was changed from aluminum chloride to calcium chloride and the number of added parts was 2.60 parts.

Production Example of Toner 1

The silica particles 1 (1.0 part) were externally mixed by using FM10C (manufactured by Nippon Coke Kogyo Co., Ltd.) with the toner particle 1 (100 parts) obtained hereinabove. The external addition conditions were as follows: the lower blade was AO blade, the distance from the deflector wall was set to 20 mm, the amount of charged toner particle: 2.0 kg, the rotation speed: 66.6 $s^{-1}$, the external addition time: 10 min, and cooling was performed at a water temperature of 20° C. and a flow rate of 10 L/min.

Thereafter, the mixture was sieved with a mesh having an opening of 200 μm to obtain a toner 1. Table 3 shows the physical properties of the toner 1 thus obtained.

Toner Production Examples 2 to 47

Toners 2 to 47 were obtained in the same manner as in the Production Example of Toner 1 except that the toner particle and silica particles used were changed to those shown in Table 3. Table 3 shows the physical properties of the toners.

TABLE 3

| Example No. | Toner No. | Toner particle No. | Toner particle surface analysis: Polyester resin No. | EI/ZI | As % | Fluorescent X-ray analysis: Polyvalent metal element | Conductivity 1/A (S/m) $\times 10^8$ | Amount B (μmol/g) | 1/A × B ($\times 10^8$) | Silica particle No. |
|---|---|---|---|---|---|---|---|---|---|---|
| 1 | 1 | 1 | 1 | 1.00 | 10 | Al | 0.370 | 0.200 | 0.074 | 1 |
| 2 | 2 | 2 | 1 | 1.00 | 10 | Fe | 0.103 | 0.750 | 0.077 | 1 |
| 3 | 3 | 3 | 1 | 1.00 | 10 | Mg | 0.222 | 10.000 | 2.220 | 1 |
| 4 | 4 | 4 | 1 | 1.00 | 10 | Ca | 0.286 | 7.500 | 2.145 | 1 |
| 5 | 5 | 5 | 1 | 1.00 | 10 | Al | 0.370 | 0.200 | 0.151 | 1 |
| | | | | | | Fe | 0.103 | 0.750 | | |
| 6 | 6 | 6 | 1 | 1.00 | 10 | Mg | 0.222 | 10.000 | 4.365 | 1 |
| | | | | | | Ca | 0.286 | 7.500 | | |
| 7 | 7 | 7 | 1 | 1.00 | 10 | Fe | 0.103 | 0.750 | 4.442 | 1 |
| | | | | | | Mg | 0.222 | 10.000 | | |
| | | | | | | Ca | 0.286 | 7.500 | | |
| 8 | 8 | 8 | 1 | 1.00 | 10 | Al | 0.370 | 0.200 | 0.074 | 1 |
| 9 | 9 | 9 | 1 | 1.00 | 10 | Al | 0.370 | 0.200 | 0.074 | 1 |
| 10 | 10 | 10 | 1 | 1.00 | 10 | Al | 0.370 | 0.200 | 0.074 | 1 |
| 11 | 11 | 11 | 2 | 1.00 | 40 | Al | 0.370 | 0.080 | 0.030 | 2 |
| 12 | 12 | 12 | 3 | 1.00 | 5 | Al | 0.370 | 0.400 | 0.148 | 3 |
| 13 | 13 | 13 | 1 | 1.00 | 10 | Fe | 0.103 | 0.270 | 0.028 | 1 |
| 14 | 14 | 14 | 1 | 1.00 | 10 | Fe | 0.103 | 1.250 | 0.129 | 1 |
| 15 | 15 | 15 | 1 | 1.00 | 10 | Mg | 0.222 | 2.000 | 0.444 | 1 |
| 16 | 16 | 16 | 1 | 1.00 | 10 | Mg | 0.222 | 20.000 | 4.440 | 1 |
| 17 | 17 | 17 | 1 | 1.00 | 10 | Ca | 0.286 | 1.500 | 0.429 | 1 |
| 18 | 18 | 18 | 1 | 1.00 | 10 | Ca | 0.286 | 15.000 | 4.290 | 1 |
| 19 | 19 | 19 | 1 | 1.00 | 10 | Al | 0.370 | 0.075 | 0.028 | 1 |
| 20 | 20 | 20 | 1 | 1.00 | 10 | Al | 0.370 | 0.450 | 0.167 | 1 |
| 21 | 21 | 21 | 1 | 1.00 | 10 | Fe | 0.103 | 0.250 | 0.026 | 1 |
| 22 | 22 | 22 | 1 | 1.00 | 10 | Fe | 0.103 | 1.280 | 0.132 | 1 |
| 23 | 23 | 23 | 1 | 1.00 | 10 | Mg | 0.222 | 1.500 | 0.333 | 1 |
| 24 | 24 | 24 | 1 | 1.00 | 10 | Mg | 0.222 | 20.200 | 4.484 | 1 |
| 25 | 25 | 25 | 1 | 1.00 | 10 | Ca | 0.286 | 1.100 | 0.315 | 1 |
| 26 | 26 | 26 | 1 | 1.00 | 10 | Ca | 0.286 | 15.500 | 4.433 | 1 |
| 27 | 27 | 27 | 4 | 1.00 | 10 | Al | 0.370 | 0.075 | 0.028 | 1 |
| 28 | 28 | 28 | 5 | 1.00 | 10 | Ca | 0.286 | 15.500 | 4.433 | 1 |
| 29 | 29 | 29 | 1 | 1.00 | 45 | Fe | 0.103 | 0.250 | 0.026 | 1 |
| 30 | 30 | 30 | 1 | 1.00 | 3 | Mg | 0.222 | 20.200 | 4.484 | 1 |
| 31 | 31 | 1 | 1 | 1.00 | 10 | Al | 0.370 | 0.200 | 0.074 | 4 |
| 32 | 32 | 31 | 1 | 0.99 | 10 | Al | 0.370 | 0.200 | 0.074 | 1 |
| C. 1 | 33 | 32 | ND | — | 10 | Al | 0.370 | 0.200 | 0.074 | 1 |
| C. 2 | 34 | 33 | ND | — | 10 | Al | 0.370 | 0.200 | 0.074 | 1 |
| C. 3 | 35 | 34 | 1 | 1.00 | 10 | — | — | — | — | 1 |
| C. 4 | 36 | 35 | 1 | 1.00 | 10 | Al | 0.370 | 0.060 | 0.022 | 1 |
| C. 5 | 37 | 36 | 1 | 1.00 | 10 | Fe | 0.103 | 0.200 | 0.021 | 1 |
| C. 6 | 38 | 37 | 1 | 1.00 | 10 | Mg | 0.222 | 0.100 | 0.022 | 1 |
| C. 7 | 39 | 38 | 1 | 1.00 | 10 | Mg | 0.222 | 0.050 | 0.023 | 1 |
| | | | | | | Ca | 0.286 | 0.040 | | |
| C. 8 | 40 | 39 | 1 | 1.00 | 10 | Al | 0.370 | 0.400 | 4.642 | 1 |
| | | | | | | Fe | 0.103 | 1.250 | | |
| | | | | | | Mg | 0.222 | 10.000 | | |
| | | | | | | Ca | 0.286 | 7.500 | | |
| C. 9 | 41 | 40 | 1 | 1.00 | 10 | Al | 0.370 | 13.000 | 4.810 | 1 |
| C. 10 | 42 | 41 | 1 | 1.00 | 10 | Fe | 0.103 | 45.000 | 4.635 | 1 |
| C. 11 | 43 | 42 | 1 | 1.00 | 10 | Mg | 0.222 | 20.500 | 4.551 | 1 |
| C. 12 | 44 | 43 | 1 | 1.00 | 10 | Ca | 0.286 | 16.000 | 4.576 | 1 |
| C. 13 | 45 | 1 | 1 | 1.00 | 10 | Al | 0.370 | 0.200 | 0.074 | 5 |
| C. 14 | 46 | 1 | 1 | 1.00 | 10 | Al | 0.370 | 0.200 | 0.074 | 6 |
| C. 15 | 47 | 1 | 1 | 1.00 | 10 | Al | 0.370 | 0.200 | 0.074 | 7 |

In the table, "C." denotes "comparison", and "ND" denotes "not detected".

Example 1

The toner 1 was evaluated as follows. Table 4 shows the evaluation results. The evaluation was performed with a commercially available color laser printer [HP LaserJet Enterprise Color Color m553dn] that was partially modified. In the modification, the process speed of the main body was modified to 300 mm/sec, and necessary adjustments were made to enable image formation under these conditions. The fixing unit was modified so that it could be changed to any temperature.

Further, the toner was extracted from the cyan toner cartridge, and the cartridge was refilled with 320 g of the toner 1. The refilled toner cartridge was mounted on the cyan station, dummy cartridges were mounted on the other stations, and the following image output test was performed.

Development Evaluation in High-Temperature and High-Humidity Environment

Fogging

In a high-temperature, high-humidity environment (temperature: 30° C./humidity: 80% RH), a printout test of 30000 prints was performed by repeating the intermittent operation of temporarily stopping the horizontal line image having a print percentage of 1% every time two prints were outputted. The apparatus was allowed to stand for 48 hours after completion of the test, a blank image was printed out again, and the reflectance (%) of the non-image portion of the obtained image was measured with "REFLECTOMETER MODEL TC-6DS" (manufactured by Tokyo Denshoku Co., Ltd.). The evaluation was performed according to the following criteria by using a numerical value (%) obtained by subtracting the obtained reflectance from the reflectance (%) of unused printout paper (standard paper) measured in the same manner.

The smaller the numerical value, the more the image fogging is suppressed.

The evaluation was performed using glossy paper (HP Brochure Paper 200 g, Glossy, manufactured by HP, 200 g/m$^2$) in the glossy paper mode. C or higher was determined to be good.

Evaluation Criteria

A: less than 0.5%

B: 0.5% or more and less than 1.5%

C: 1.5% or more and less than 3.0%

D: 3.0% or more

Density Stability

The image density was determined by outputting a sample image in which a solid black image of 20 mm square was printed at the four corners and the center of a Canon color laser copy paper (A4: 81.4 g/m$^2$), measuring the reflection density with X-Rite 500 series (manufactured by Vedeojet X-Rite K. K.), and calculating the average value of image density at five points.

The present evaluation was performed in a high-temperature and high-humidity environment (30° C./80% RH) and in a low-temperature and low-humidity environment (15° C./10% RH). The image outputted after further allowing to stand for 48 hours after outputting 30000 prints by the same intermittent operation as described hereinabove was taken as a durable image, and the density change width between the initial image and the durable image was evaluated according to the following evaluation rank. C or higher was determined to be good.

Evaluation Criteria

A: the difference between the initial image density and the image density after durability is less than 0.10

B: the difference between the initial image density and the image density after durability is 0.10 or more and less than 0.15

C: the difference between the initial image density and the image density after durability is 0.15 or more and less than 0.20

D: the difference between the initial image density and the image density after durability is 0.20 or more Development Evaluation in Low-Temperature and Low-Humidity Environment Developing Performance Under a low-temperature and low-humidity environment (temperature 15° C./humidity 10% RH), a printout test of 30000 prints was performed by repeating an intermittent operation of temporarily stopping a horizontal line image having a print percentage of 1% every time two prints were outputted. After the printout of 30000 prints, a ghost evaluation chart, which included a solid patch and a halftone image, and a solid white image were outputted, and image damage due to charge-up was evaluated according to the following evaluation rank. C or higher was determined to be good.

The recording medium used was Canon color laser copy paper (A4: 81.4 g/m$^2$).

Evaluation Criteria

A: good as in the initial image

B: a patch mark is slightly seen on the halftone image after the solid patch is printed C: a patch mark is clearly seen on the halftone image after the solid patch is printed.

D: a patch mark is clearly seen on the halftone image after the solid patch is printed, and vertical stripes due to poor regulation are seen on the solid white image Evaluation of Fixability Low-Temperature Fixability In a normal-temperature and normal-humidity environment (23° C., 50% RH), the toner laid-on level on the output paper was adjusted to 0.20 mg/cm$^2$, and a fixed image having a length of 2.0 cm and a width of 15.0 cm was formed in a portion of 1.0 cm from the upper end in the paper passage direction. Color laser copier paper (manufactured by Canon Inc., 80 g/m$^2$) was used as a recording medium.

The fixability evaluation was performed at each temperature while the initial temperature was set to 120° C. and the set temperature was raised by 5° C. sequentially.

The evaluation criteria for the low-temperature fixability are as follows. The low-temperature-side fixing start point is the lowest temperature at which the reduction rate of image density before and after rubbing is 10.0% or less when the surface of the image is rubbed five times at a speed of 0.2 m/sec with silbon paper (Dasper K-3) under a load of 4.9 kPa (50 g/cm$^2$). When the fixing is not performed firmly, the reduction rate of image density tends to increase.

Table 4 shows the evaluation results. C or higher was determined to be good.

Evaluation Criteria

A: low-temperature-side fixing start point is 130° C. or less

B: low-temperature-side fixing start point is 135° C. or 140° C.

C: low-temperature-side fixing start point is 145° C. or 150° C.

D: low-temperature-side fixing start point is 155° C. or more

Examples 2 to 32

In Examples 2 to 32, the above evaluation was performed using toners 2 to 32, respectively.

The evaluation of toners 8 to 10 in Examples 8 to 10 was performed in the same manner as in Example 1 by changing the toner cartridge to be used to yellow, magenta, and black, respectively, refilling the toner, and mounting on the corresponding station. Table 4 shows the results of each evaluation.

Comparative Examples 1 to 15

In Comparative Examples 1 to 15, the above evaluation was performed using toners 33 to 47, respectively. Table 4 shows the results of each evaluation.

TABLE 4

| Example No. | Toner particle No. | HH Fogging | HH Density stability Initial/After durability | HH Rank | LL Density stability Initial/After durability | LL Rank | Developing performance | Fixability |
|---|---|---|---|---|---|---|---|---|
| 1 | 1 | A | 1.40/1.38 | A | 1.40/1.42 | A | A | A |
| 2 | 2 | A | 1.41/1.39 | A | 1.41/1.43 | A | A | A |
| 3 | 3 | A | 1.39/1.38 | A | 1.39/1.42 | A | A | A |
| 4 | 4 | A | 1.40/1.37 | A | 1.40/1.43 | A | A | A |
| 5 | 5 | A | 1.40/1.38 | A | 1.40/1.43 | A | A | A |
| 6 | 6 | B | 1.40/1.28 | B | 1.40/1.38 | A | A | A |
| 7 | 7 | C | 1.40/1.26 | B | 1.40/1.37 | A | A | A |
| 8 | 8 | A | 1.43/1.40 | A | 1.40/1.43 | A | A | A |
| 9 | 9 | A | 1.38/1.36 | A | 1.38/1.41 | A | A | A |
| 10 | 10 | A | 1.41/1.38 | A | 1.41/1.43 | A | A | A |
| 11 | 11 | C | 1.42/1.23 | C | 1.42/1.59 | C | C | A |
| 12 | 12 | C | 1.40/1.23 | C | 1.40/1.55 | C | C | B |
| 13 | 13 | A | 1.40/1.38 | A | 1.40/1.54 | B | C | A |
| 14 | 14 | B | 1.40/1.29 | B | 1.40/1.42 | A | A | A |
| 15 | 15 | A | 1.40/1.38 | A | 1.40/1.52 | B | B | A |
| 16 | 16 | C | 1.37/1.23 | B | 1.38/1.25 | B | A | A |
| 17 | 17 | A | 1.40/1.38 | A | 1.40/1.42 | A | B | A |
| 18 | 18 | C | 1.38/1.24 | B | 1.39/1.35 | A | A | A |
| 19 | 19 | A | 1.35/1.49 | B | 1.35/1.52 | C | C | A |
| 20 | 20 | B | 1.34/1.20 | B | 1.40/1.42 | A | A | A |
| 21 | 21 | A | 1.33/1.47 | B | 1.33/1.52 | C | C | A |
| 22 | 22 | B | 1.34/1.20 | B | 1.40/1.42 | A | A | A |
| 23 | 23 | A | 1.40/1.38 | A | 1.45/1.59 | B | B | A |
| 24 | 24 | C | 1.35/1.16 | C | 1.38/1.22 | C | A | A |
| 25 | 25 | A | 1.40/1.38 | A | 1.45/1.59 | B | B | A |
| 26 | 26 | C | 1.36/1.18 | C | 1.38/1.23 | C | A | A |
| 27 | 27 | A | 1.40/1.55 | C | 1.37/1.56 | C | C | A |
| 28 | 28 | C | 1.30/1.11 | C | 1.33/1.15 | C | A | A |
| 29 | 29 | C | 1.40/1.51 | B | 1.40/1.56 | C | C | A |
| 30 | 30 | C | 1.37/1.18 | C | 1.38/1.23 | C | A | C |
| 31 | 1 | B | 1.42/1.57 | C | 1.45/1.62 | C | C | A |
| 32 | 31 | C | 1.30/1.11 | C | 1.32/1.15 | C | A | A |
| C.E. 1 | 32 | A | 1.35/1.45 | B | 1.33/1.65 | D | D | C |
| C.E. 2 | 33 | A | 1.37/1.49 | B | 1.35/1.66 | D | D | B |
| C.E. 3 | 34 | A | 1.39/1.63 | D | 1.37/1.77 | D | D | A |
| C.E. 4 | 35 | A | 1.40/1.59 | C | 1.40/1.70 | D | D | A |
| C.E. 5 | 36 | A | 1.41/1.58 | C | 1.42/1.71 | D | D | A |
| C.E. 6 | 37 | A | 1.39/1.57 | C | 1.39/1.69 | D | D | A |
| C.E. 7 | 38 | A | 1.40/1.56 | C | 1.41/1.70 | D | D | A |
| C.E. 8 | 39 | D | 1.40/1.23 | C | 1.40/1.26 | B | A | A |
| C.E. 9 | 40 | D | 1.43/0.98 | D | 1.40/1.22 | C | A | A |
| C.E. 10 | 41 | D | 1.41/1.25 | C | 1.41/1.28 | B | A | A |
| C.E. 11 | 42 | D | 1.38/1.19 | C | 1.39/1.26 | B | A | A |
| C.E. 12 | 43 | D | 1.39/1.20 | C | 1.39/1.27 | B | A | A |
| C.E. 13 | 1 | C | 1.38/1.15 | D | 1.38/1.75 | D | D | A |
| C.E. 14 | 1 | D | 1.39/1.21 | C | 1.39/1.72 | D | D | B |
| C.E. 15 | 1 | D | 1.40/1.12 | D | 1.40/1.78 | D | D | A |

In the table, "C.E." denotes "Comparative Example".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-047177, filed Mar. 14, 2019, and No. 2020-025110, filed Feb. 18, 2020 which are hereby incorporated by reference herein in their entirety.

What is claimed is:

1. A toner, comprising:

a toner particle comprising a binder resin and a polyvalent metal element;

an external additive comprising a spherical silica particle having a number average particle diameter of 20-40 nm and a circularity of 0.80 or more; and a surface of the toner particle comprising a polyester resin, wherein $0.025\times10^8 \leq (1/A)\times B \leq 4.500\times10^8$ where A (Ω·m) is an electrical resistivity of the polyvalent metal element at 20° C., and B (μmol/g) is an amount of the polyvalent metal element in the toner particle.

2. The toner according to claim 1, wherein the polyvalent metal element is at least one member selected from the group consisting of aluminum, iron, magnesium and calcium.

3. The toner according to claim 2, wherein when the polyvalent metal element includes aluminum, the amount of aluminum in the toner particle is 0.080 to 0.400 μmol/g, when the polyvalent metal element includes iron, the amount of iron in the toner particle is 0.270 to 1.250 μmol/g, when the polyvalent metal element includes magnesium, the amount of magnesium in the toner particle is 2.000 to 20.000 μmol/g, and when the polyvalent metal element includes calcium, the amount of calcium in the toner particle is 1.500 to 15.000 μmol/g.

4. The toner according to claim 1, wherein a weight average molecular weight Mw of the polyester resin is 10000 to 60000; and a concentration of ester groups in the polyester resin is 20 to 50% by mass.

5. The toner according to claim 1, wherein the spherical silica particle is a sol-gel silica particle.

6. The toner according to claim 1, wherein the toner particle includes wax, and As is 5 to 40%, where As is a ratio of an area occupied by the wax in a region from the toner particle surface to a depth of 1.0 μm in cross-sectional observation of the toner using a transmission electron microscope.

7. The toner according to claim 1, wherein the toner particle is an emulsion aggregation toner particle.

8. The toner according to claim 1, wherein the binder resin is a polyester resin.

9. A method for producing the toner according to claim 1, the method comprising the steps of:

aggregating fine particles of the binder resin to form aggregated particles; and fusing the aggregated particles to obtain the toner particle.

* * * * *